US006062668A

United States Patent [19]

Cruz-Uribe

[11] Patent Number: 6,062,668

[45] **Date of Patent: *May 16, 2000**

[54] DROP DETECTOR FOR INK JET APPARATUS

[75] Inventor: Tony Cruz-Uribe, Corvallis, Oreg.

[73] Assignee: Hitachi Koki Imaging Solutions, Inc., Simi Valley, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/764,784

[22] Filed: Dec. 12, 1996

[51] Int. Cl.[7] ..... B41J 2/195

[52] U.S. Cl. ..... 347/19; 374/163; 374/166

[58] Field of Search ..... 347/7, 9, 14, 17, 347/19, 23, 54, 120, 135, 163, 166

[56] References Cited

U.S. PATENT DOCUMENTS

| | | | |
|---|---|---|---|
| 3,872,318 | 3/1975 | Murayama | 307/400 |
| 3,898,673 | 8/1975 | Haskell | 347/80 |
| 4,067,019 | 1/1978 | Fleishcer et al. | 347/81 |
| 4,323,905 | 4/1982 | Reitberger et al. | 347/6 |
| 4,835,435 | 5/1989 | Yeung et al. | 310/324 |
| 5,508,722 | 4/1996 | Saito et al. | 347/17 |
| 5,644,343 | 7/1997 | Allen | 347/17 |

FOREIGN PATENT DOCUMENTS

| | | |
|---|---|---|
| 0 562 786 A2 | 3/1993 | European Pat. Off. . |
| 0 635 372 A2 | 7/1994 | European Pat. Off. . |

OTHER PUBLICATIONS

International Search Report for PCT Application No. PCT/US97/22057 dated Dec. 10, 1997.

Japan Patent Abstract, Publication No. 56038267 dated Apr. 13, 1981.

*Primary Examiner*—John Barlow
*Assistant Examiner*—Craig A. Hallacher
*Attorney, Agent, or Firm*—Pillsbury Madison & Sutro LLP

[57] ABSTRACT

A drop detection apparatus has a thermosensitive substrate for receiving drops of ink and providing a signal representative of a change in the temperature in the thermosensitive substrate which is caused by the ink drops deposited on the thermosensitive substrate. The thermosensitive substrate is made from a pyroelectric material, such as, for example, polyvinylidene fluoride (PVDF) and lead zirconium titanate (PLZT). As a result, a drop detection apparatus has a substantially simplified structure for detecting drops of ink ejected from large numbers of jets. Furthermore, since a drop detection apparatus relies on the temperature difference between the thermosensitive substrate and the drop of ink which is substantially small in size, the drop detection apparatus can be made substantially small in size, therefore suitable for a small sized ink jet apparatus.

37 Claims, 10 Drawing Sheets

DROP DETECTOR FOR INK JET APPARATUS

BACKGROUND OF THE INVENTION

1. Field of the Invention

The present invention relates to drop detectors for detecting particles or liquids that are propelled toward and adhere to substrates and, in preferred embodiments, to a method and apparatus for detecting drops of a jettable liquid (such as ink) ejected from an ink jet apparatus onto a substrate, based on heat content of the liquid drop.

2. Description of Related Art

Various approaches have been considered for identifying drops of ink ejected from an ink jet apparatus. Such approaches include sensing the impact force of drops on a mechanical structure, interrupting a beam of light by drops of ink, sensing differences in the drive waveform, measuring the mass build up on a target, and observing changes in electrical charge as a drop is ejected.

For example, U.S. Pat. No. 4,323,905 to Reitberger, et al, describes an example of an impact force sensing device for detecting the presence of ink droplets during the ink jet printing operations. The impact sensing device comprises a foil having a metal layer which is placed over a counter electrode. A voltage is applied to the electrode and the metal layer. The force of an ink droplet impinging on the foil momentarily deflects the foil and causes a change in capacity which in turn causes a voltage change at the electrode, whereby the presence of the ink droplet is detected.

U.S. Pat. No. 4,835,435 ('435 patent) describes another impact force type drop detector that produces an output signal with a selected resonant frequency when the detector is struck by a drop. The drop detector has a piezoelectric membrane mounted to a substrate. When a drop strikes the piezoelectric membrane, the membrane vibrates at the selected resonant frequency. The vibrations of the membrane produce an output signal having a frequency equal to the selected resonant frequency. However, with these impact type drop detectors, which rely on deflection or vibrations of a very sensitive membrane, it can be difficult to isolate the vibration caused by a drop of ink from acoustic or other vibrations caused by background noise.

Another prior art approach to drop detection uses optical devices. Such approaches typically employ an emitter for directing a collimated beam of light at a photodetector. When a drop travels through the light beam, the photodetector output varies to thereby indicate the detection of a drop. However, the emitter and the photodetector in such systems must be precisely aligned so that drop trajectory would fall within the collimated beam of light. The precise alignment of the optical system is relatively difficult and subject to mechanical failure.

Typically, in order to detect drops from large arrays of jets at the same time, these prior art drop detectors would tend to become substantially large in size, precluding some compact ink jet apparatus designs. Alternatively, for smaller sized prior art drop detectors to detect drops from large arrays of jets, the jet array or the detector must be moved so that each jet could be tested. As a result, the process to determine whether or not all the jets are normally operating can be relatively time inefficient and can require relatively complex mechanical movements.

SUMMARY OF THE DISCLOSURE

It is an object of embodiments of the present invention to provide a method and an apparatus for detecting particles or drops of liquid (such as ink) with improved reliability.

It is another object of embodiments of the present invention to provide a drop detection apparatus which is compact in size and allows simultaneous or near simultaneous detection of drops of material ejected from an array of ink jets.

This is achieved in a drop detection apparatus having, in accordance with one embodiment of the present invention, a thermosensitive substrate provided in thermal communication with drops of ink and providing a signal representative of a change in the temperature of the thermosensitive substrate over time, caused by the drops. The drop detection apparatus may be configured with a relatively simplified structure, small in size yet be capable of detecting drops of ink or other material ejected from large numbers of jets.

According to a preferred embodiment, a drop detection apparatus includes a thermosensitive device which receives (or behind and abutting a substrate which receives) the droplets ejected from an ink jet apparatus, where the droplets have a temperature different from the temperature of the thermosensitive device. When the droplets contact the thermosensitive device (or the substrate adjacent the thermosensite device), the droplets result in a temporary temperature change on at least a local portion of the thermosensitive device. In accordance with preferred embodiments of the present invention, the thermosensitive device is made of pyroelectric material that generates an electric current proportional to the change in temperature $\Delta T$ over time $\Delta t$. The pyroelectric thermosensitive device generates an electrical current signal related to the ratio $\Delta T/\Delta t$.

The thermosensitive device 16 comprises a pyroelectric detector 18 having a pyroelectric material 20 sandwiched between two thin film electrodes 22 and 24. The pyroelectric material 20 may be for example, a piezoelectric film such as polyvinylidene fluoride (PVDF), or a piezoceramic sheet such as lead zirconium titanate (PZT), lead lanthanum zirconate titanate (PLZT), and the like.

The thermosensitive device may be readily made with segmented pyroelectric material or segmented electrodes to allow detection of droplets ejected from a plurality of adjacently disposed ink jets, as discussed below. The area of the pyroelectric material that is effected by the change in temperature from each droplet is dependent upon the size of the droplet. Thus, for small droplets, the size of the thermosensitive device may be made relatively small. Moreover, the laminate or layered (sandwiched) structure may be readily configured for narrow, small spaces, such as the small confines of an ink jet printing apparatus, and may be readily manufactured using conventional coating, plating or deposition techniques or the like.

These and other objects and advantages will be readily apparent from the following description and drawings of preferred embodiments.

BRIEF DESCRIPTION OF THE DRAWINGS

FIG. 2(*b*) is a front view of the drop detector shown in FIG. 2(*a*).

FIG. 11(*b*) is a side view of the drop detector shown in FIG. 11(*a*).

FIG. 13(*b*) is a rear view of a pyroelectric strip device to be disposed on the substrate shown in FIG. 13(*a*).

FIG. 13(*c*) is a front view of the pyroelectric strip device shown in FIG. 13(*b*).

FIG. 13(*d*) is a front view of a drop detector comprising a pyroelectric strip device as shown in FIGS. 13(*b*) and 13(*c*) disposed on a substrate as shown in FIG. 13(*a*).

DETAIL DESCRIPTION OF PREFERRED EMBODIMENTS

Figure 1:
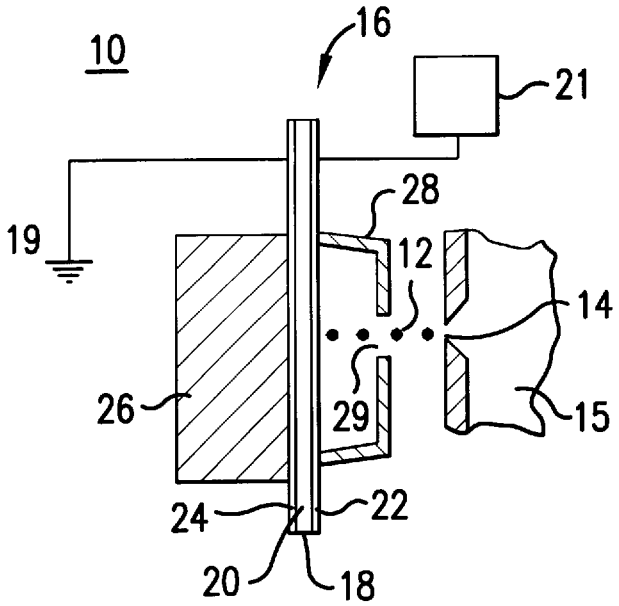
FIG. 1 is a side cross-section view of a drop detector and a portion of an ink jet head in accordance with one embodiment of the present invention.

A drop detection apparatus in accordance with one embodiment of the present invention is indicated generally at 10 in FIG. 1. The drop detection apparatus 10 may be mounted within an ink jet printer (not shown) to detect the presence of droplets 12 ejected from an orifice 14 of an ink jet device 15, to thereby verify if the ink jet device 15 is operating normally and is ejecting droplets 12. The ink jet device 15 may comprise the jet head of an ink jet, bubble jet, or other suitable jetting device.

The drop detection apparatus 10 includes a thermosensitive device 16 which receives the droplets 12. The droplets 12 have a temperature different from the temperature of the thermosensitive device 16. The droplets 12 may be heated above the temperature of the thermosensitive device 16 for the purpose of allowing thermal detection or for other purposes as well. For example, many ink jet heads are designed to operate with hot melt materials such as hot melt ink in which the ink is heated above the melting temperature prior to the ejection from the ink jet head. Other ink jet devices use heaters to control the viscosity of the setted material and improving print quality, dot size, and penetration in the print surface.

When the droplets 12 contact the thermosensitive device 16, the droplets result in a temporary temperature change on at least a local portion of the thermosensitive device 16. In accordance with preferred embodiments of the present invention, the thermosensitive device 16 is made of pyroelectric material that generates an electric current proportional to the change in temperature $\Delta T$ over time $\Delta t$.

The temperature rise in the thermosensitive device 16 depends on many factors, such as, for example, the temperatures and masses of the ink and the thermosensitive device 16, the heat capacity of the thermosensitive device 16, the latent heat of the ink, the dimensions and thermal sinking characteristics of the thermosensitive device 16, and the time required to deposit the ink. Experiments were conducted in connection with the present invention to consider the effects of these factors on the ink jet apparatus having arrays of jets in various sizes. As a result, it has been found that the pyroelectric effect can provide a relatively low cost and efficient mechanism for detecting a single droplet or multiple droplets ejected simultaneously or near simultaneously.

In the illustrated preferred embodiments, the present invention will be described primarily with reference to thermosensitive devices using the pyroelectric effect. Pyroelectric embodiments are preferred because the pyroelectric effect is dependent upon a change in temperature $\Delta T$ over a period of time $\Delta t$ and can be used to generate an electrical current signal related to the ratio $\Delta T/\Delta t$. However, it should be appreciated that other embodiments employ a thermosensitive device utilizing the resistance effect or the thermoelectric effect.

As shown in FIG. 1, the thermosensitive device 16 comprises a pyroelectric detector 18 having a pyroelectric material 20 sandwiched between two thin film electrodes 22 and 24. The pyroelectric material 20 may be for example, a piezoelectric film such as polyvinylidene fluoride (PVDF), or a piezoceramic sheet such as lead zirconium titanate (PZT), lead lanthanum zirconate titanate (PLZT), and the like. The pyroelectric detector 18 is bonded to an aluminum block 26 which supports the pyroelectric detector 18 and functions as a heat sink. In the illustrated embodiment, the pyroelectric detector 18 is formed from a piece of 28 $\mu$m thick PVDF, and cut into a generally rectangular shape which is about 1.1 inches long and 0.5 inches wide.

As shown in FIG. 1, the electrode 24 of the pyroelectric detector 18 is grounded at 19 and the electrode 22 is coupled to a drop detection circuit 21. A example drop detector circuit for use with a test arrangement configured to test the operability of various pyroelectric devices in a drop detecting application is shown and described below in conjunction with FIG. 3. However, it will be understood that further embodiments of the drop detection circuit 21 employ other circuit configurations suitable for processing signals provided by pyroelectric devices described herein.

Air currents adjacent to the pyroelectric detector 18 can cause drifting in the output from the device. Therefore, an air shield 28 is preferably provided adjacent to the surface of the pyroelectric detector 18 for blocking air flow in the space between the ink jet device 15 and the pyroelectric detector 18 to thereby minimize the drifting of the detector 18. The shield 28 may be made of any material and configuration suitable for providing a barrier against air flow. The shield 28 is provided with an aperture 29 through which droplets 12 pass. In another embodiment, the background drift may be subtracted from the output by inputting into a differential amplifier signals from the detector and a second detector located in the same general environment but which does not receive ink droplets.

Figure 2A:
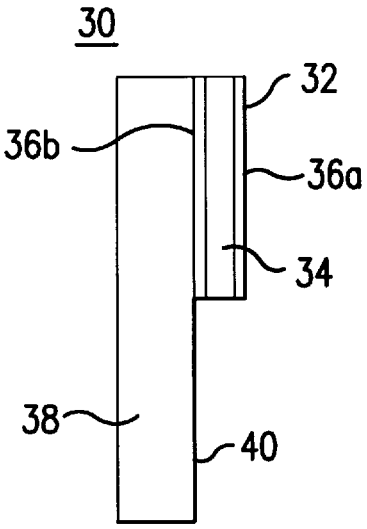
FIG. 2(*a*) is a side view of a drop detector in accordance with another embodiment of the present invention.
Figure 2B:
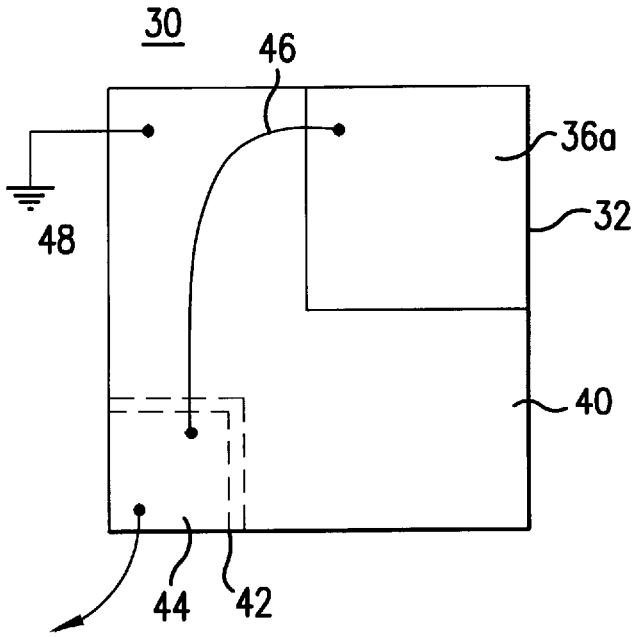

FIGS. 2(*a*) and 2(*b*) show a drop detection apparatus 30 in accordance with another embodiment of the present invention. The drop detection apparatus 30 may be mounted within an ink jet printer (not shown) in a similar manner as the drop detection apparatus shown in FIG. 1. The drop detection apparatus 30 includes a pyroelectric detector 32 for the detection of droplets ejected from ink jets (not shown). The pyroelectric detector 32 is formed from a sheet of pyroelectric material, for example, a piece of 0.005 inches thick #3202 PLZT which is manufactured by Motorola Corporation. In the illustrated embodiment, the pyroelectric detector 32 is cut into a generally 1 cm×1 cm square shape. The pyroelectric detector 32 comprises a thin sheet 34 of lead lanthanum zirconium titanate (PLZT), and has conductor layers 36*a* and 36*b* on either side thereof. The conductor layers 36*a* and 36*b* may be formed from a suitable conductive material, including metal, such as, for example, nickel, silver and gold, for electrical connections to the PLZT sheet. The pyroelectric detector 32 is bonded to an approximately 1 inch square PC board 38 that is cladded with a copper film 40. In the illustrated embodiment, the copper cladded surface of the PC board 38 is etched along dotted lines 42 to form a pad 44. A thin copper lead 46 is attached at its one end to the electrode 36*a* of the pyroelectric detector 32 and to the pad 44 at the other end thereof. The conductor layer 36*b* is electrically connected to the copper film 40 which is grounded at 48. Electrical connection is made to a drop detection circuit (not shown) at the pad 44.

According to a preferred embodiment of a drop detection system and process, a drop detection circuit (such as shown at 21 in FIG. 1) is coupled to pad 44. The pyroelectric device provides a current (I) to the drop detection circuit, which is related to the change in temperature ΔT of the pyroelectric material over a period of time Δt. The drop detection circuit includes a resistor circuit, for converting the current signal into a voltage signal, and a circuit for analyzing the change in voltage amplitude Δv over time. The analyzing circuit may, for example, compare the detected Δv with a preset or expected characteristic to determine whether the ink jet device is operating correctly. Such Δv characteristics are discussed herein, in connection with tests discussed below. In this manner the drop detection system may be included, for example, in an ink jet printer and controlled to periodically test the operation of the ink jet head, e.g. prior to each print job or at the end of a print line a print page, or at the end of a selected number of lines, pages or time period. Also, because the pyroelectric material is responsive to temperature changes over time, the system may be sensitive to the rate of droplet emission. That is, for a given drop size and drop composition and temperature, a given change in temperature ΔT occurs in a given amount of time Δt at a given emission rate. Thus, various characteristics of the operation of the ink jet device, such as the emission rate, missing droplets (skipping), droplet temperature and the like may be detected. In addition, the emission rate may be adjusted to increase (or decrease) the sensitivity of the drop detection system.

Figure 3:
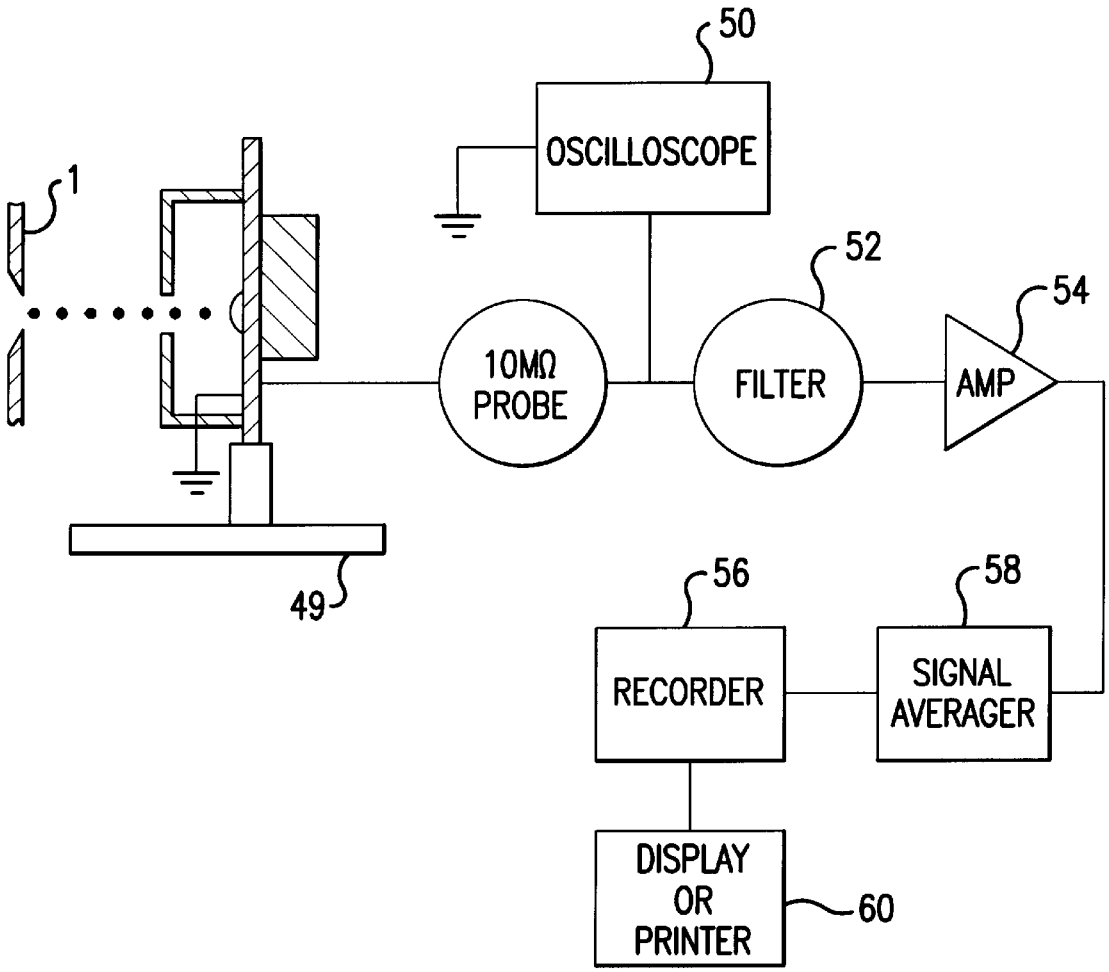
FIG. 3 is a block diagram representing a system for recording the detection of ink droplets.

A test set-up as shown in FIG. 3 may be used to illustrate characteristics of the drop detection apparatuses 10 and 30. Referring to FIG. 3, each of the drop detection apparatuses 10 and 30 is mounted on a micrometer stage 49 and set at predetermined distances from the printhead ranging from 0.5 inches to 0.03 inches. Each of the pyroelectric detectors 18 and 32 is placed close enough to the printhead so that the heat from the printhead communicates to the pyroelectric detectors 18 and 32.

As shown in FIG. 3, the output of the respective drop detection apparatuses 10 and 30 is monitored, via a 10 MΩ probe, with an oscilloscope 50. In addition, the signal is sent to a bandpass filter 52, an amplifier 54, and a recorder 56 with a signal averager 58. The output is then shown on a display device and/or printed by a printer 60.

Figure 4:
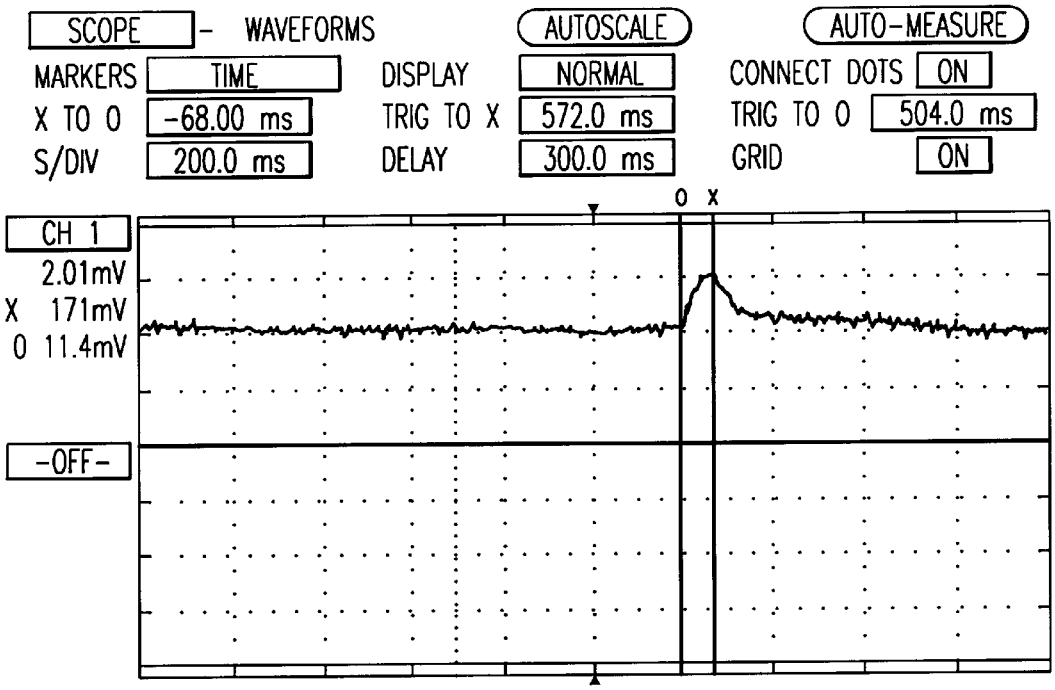
FIGS. 4–10 show waveform displays representative of temperature changes in various thermosensitive targets.

In a first test, the pyroelectric detector 18 (PVDF film), as shown in FIG. 1, was placed about 0.2 inches from the printhead. Then, 500 droplets (each weighing about 76 ng) of cyan ink were emitted at the rate of 8 kHz to a region of the pyroelectric detector 18 which was not supported by the aluminum block 26. As shown in FIG. 4, the pyroelectric detector 18 showed a very fast response. The current generated by the PVDF device (I ΔT/Δt) was converted to a voltage with a resistor circuit (V=IR ΔT/ΔtR) which reached its peak in about 70 milliseconds. A voltage generated upon the deposition of the burst of the ink droplets (Δ V) was about 160 millivolts. The signal-to-noise ratio was about 10:1 with no signal averaging or filtering. When the droplets hit a region of the detector 16 which was supported by the block 26, the amplitude was approximately 50 millivolts, which is much less than that recorded when droplets were deposited at the unsupported region. This suggests that the aluminum block 26 has a significant temperature clamping effect which may or may not be preferred, depending upon the application and sensitivity requirements. Also, it was found that the optimum thickness for the PVDF membrane was about 3.2 times 28 μm or about 90 μm.

Figure 5:
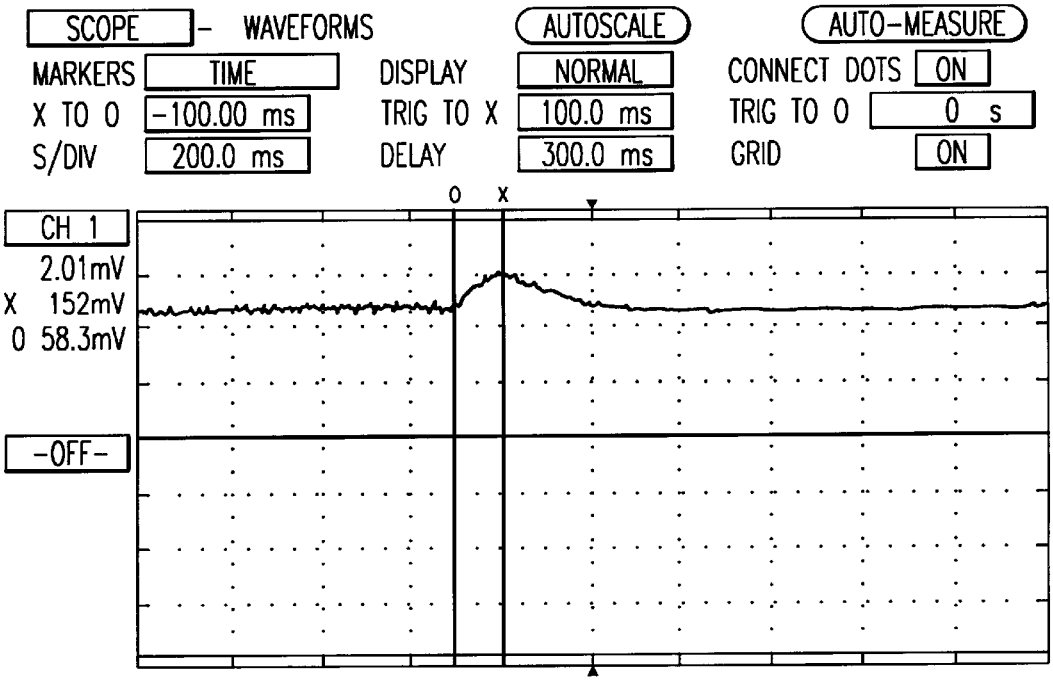

In a second test, the pyroelectric detector (PLZT sheet) 32 as shown in FIGS. 2(*a*) and 2(*b*) was tested in a similar manner as the detector 18 of FIG. 1. That is, 500 droplets (each weighing about 76 ng) of cyan ink were emitted at the rate of 8 kHz toward the pyroelectric detector 32. FIG. 5 shows a plot of the second test which shows a peak signal of about 93 millivolt. It is observed that the waveform resembles that for the temperature at a point on the surface of a semi-infinite slab due to an instantaneous heat input at a point nearby. The waveform for the PLZT pyroelectric detector 32 as shown in FIG. 5 differs from that for the PVDF pyroelectric detector 18 which shows two distinct cooling constants. At 4 kHz and 2 kHz drop emission rates, the amplitude fell to 65 millivolt.

Figure 6:
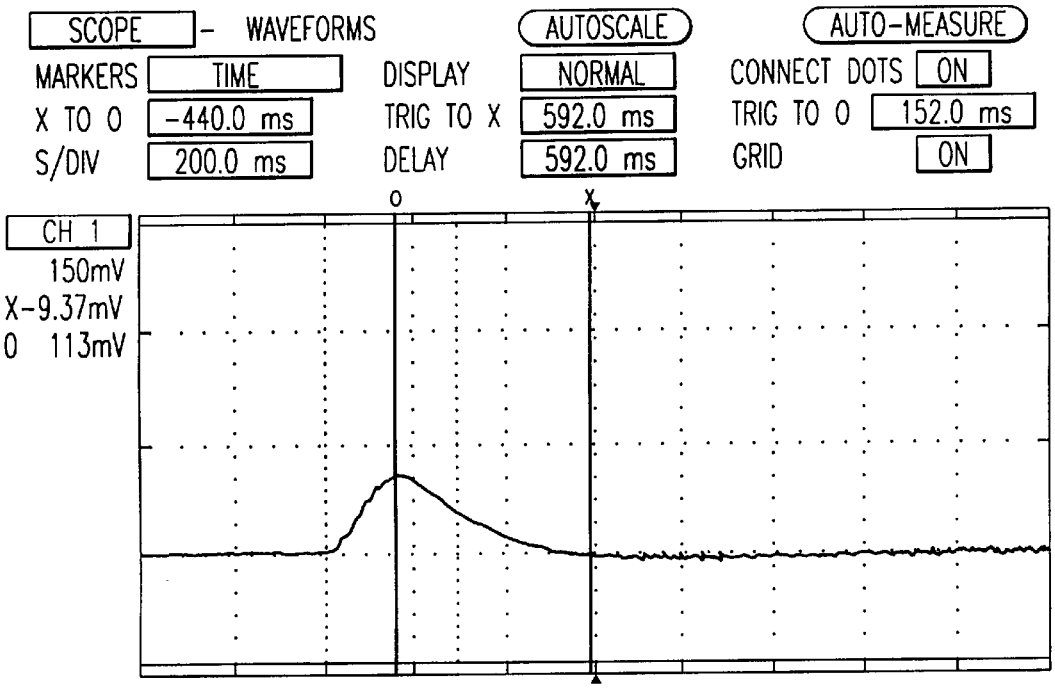

In a third test, the surface of the printhead 15 was heated to 131° C., and the PLZT pyroelectric detector 32 was arranged relatively close to the printhead 15 (about 0.12 inches from the 15 printhead) to raise the temperature of the detector 32 above the melting point of the hot melt ink (about 80° C.) to thereby allow the ink to stay liquid after impact on the pyroelectric detector. Again, 500 droplets (each weighing 76 ng) of cyan ink were emitted at the rate of 4 kHz to the pyroelectric detector 32. FIG. 6 shows a plot of the temperature pulse after 8 averages. The plot of FIG. 6 shows the peak amplitude at about 105 millivolt.

Figure 7:
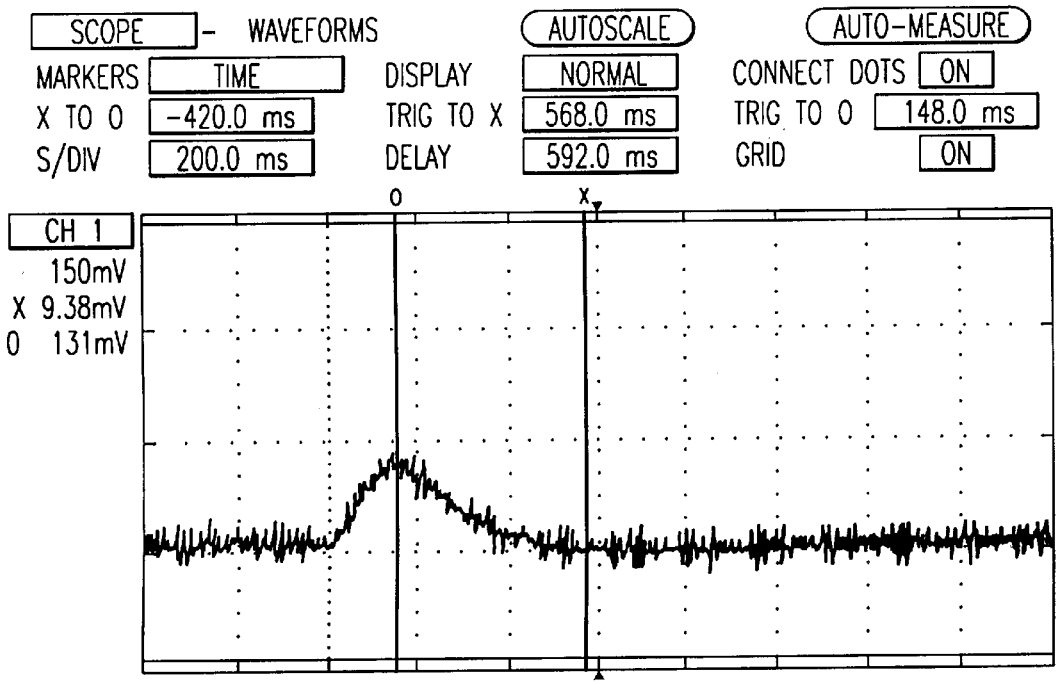
Figure 8:
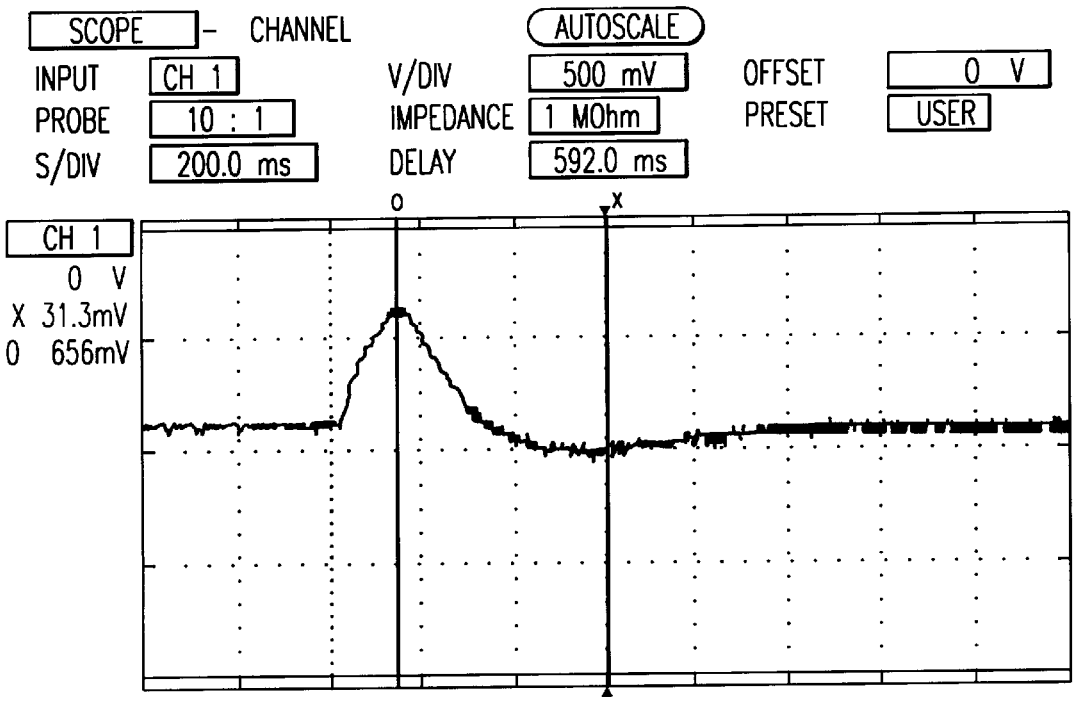

FIG. 7 shows a waveshape obtained by a single burst of droplets deposited on the PLZT pyroelectric detector 32 without signal averaging. Again, 500 droplets were ejected at the emission rate of 4 kHz to the pyroelectric detector 32. The S/N ratio is approximately 7:1. The noise can be further reduced by narrowing the bandwidth. For example, as shown in FIG. 8, when the filter 52 is set between 0.1 Hz and 300 Hz, and the amplifier gain is set at 20×, the S/N ratio is increased to more than 20:1.

Figure 9:
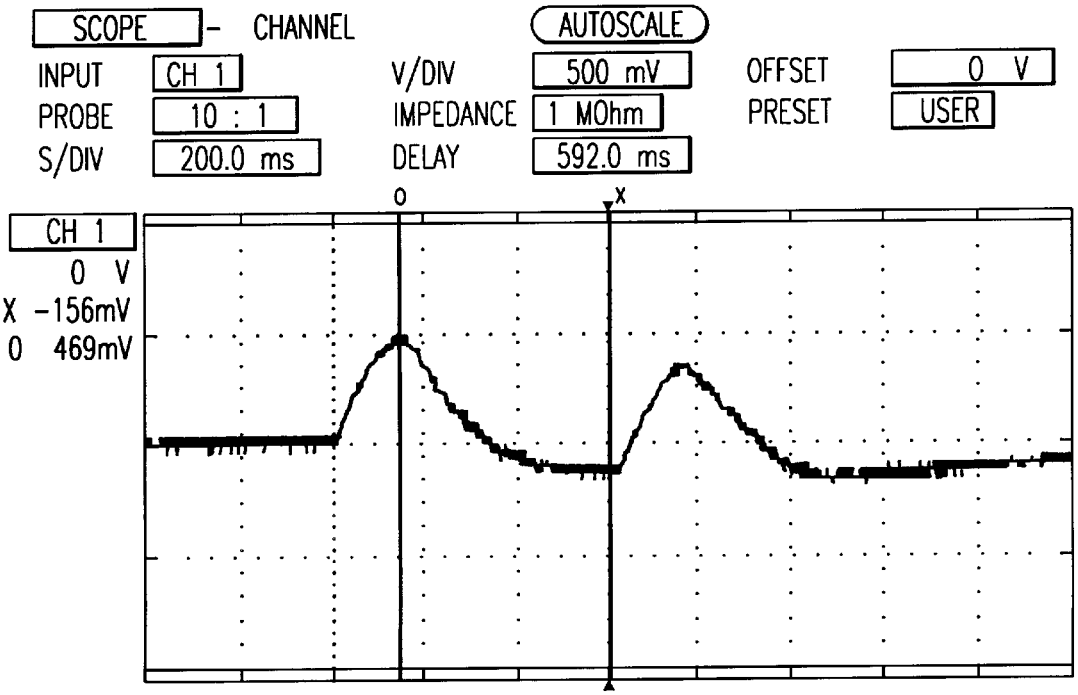

In a fourth test, two successive bursts were fired to observe whether the presence of the liquid on the pyroelectric detector formed by the first burst affects the second signal to be generated by the second burst. Two successive bursts each consisting of 500 droplets (each weighing about 42 ng) of cyan ink were ejected, at the emission rate of 4 kHz, toward the pyroelectric detector 32. The filter 52 was set between 0.1 Hz and 300 Hz, and the amplifier gain was set at 10×. No change in the amplitude of the second peak relative to the first peak was observed as shown in FIG. 9. However, the second peak is lower than the first since the starting point for the second pulse was less than zero. This negative excursion appears on most plots of waveforms, and the size of the negative excursion varies. However, the size of the negative excursion does not exceed 25% of the peak.

Figure 10:
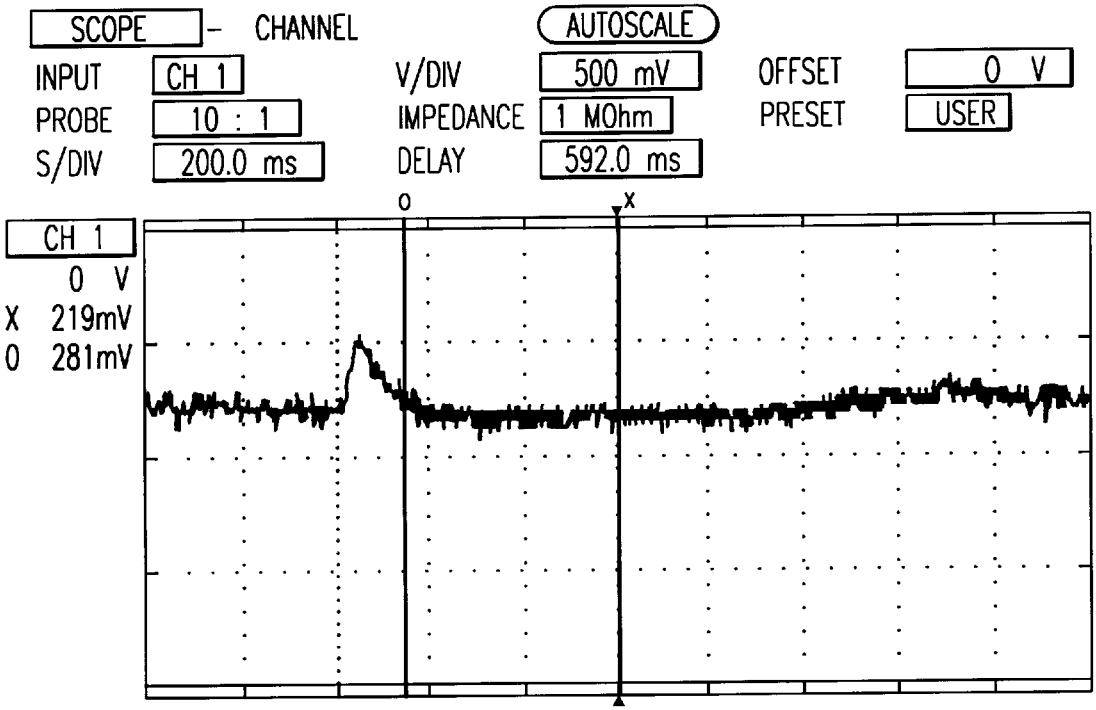

In a fifth test, a signal was obtained with a reduced number of droplets. In this example, the number of droplets (each weighing about 42 ng) was reduced to 50, and the gain was set to 50×. As shown in FIG. 10, the pulse is clearly visible with such a reduced number of droplets.

It is observed from the above tests that the region generating a signal is the area where most of the fast temperature rise is occurring. This was a circle between 0.001" and 0.0015" in diameter, as determined by the dimensions of a drop on the substrate. Most of the heat change occurs in the region of the substrate directly below (under) the deposited drop in this circle.

A burst of drops (e.g., 500 drops) would result in greater ink spreading than a single drop. Therefore, most of the heat change occurs in a region circumscribed by a circle of greater diameter than the single drop circle diameter discussed above. Because the heat from the deposited drops tends to be communicated primarily to the region directly below (under) the spread area of the deposited drops, the detector area need not be significantly greater (or no greater) than the spread area of the burst of drops. Thus, an area of 0.02"×0.02" is generally sufficient to detect the presence of a burst of droplets (e.g., 500 drops, each of about 0.76 ng). Therefore, a single piece of pyroelectric material can be formed into a detector for an array of drops by segmenting the electrodes into 0.02"×0.02" regions and locating each immediately opposite a respective jet of a multi-jet head.

As a result, the detector can be made substantially small in size. Furthermore, since the duration of the peak is approximately 50 millisecond, individual detectors can be sampled in shorter time slices allowing for simultaneous emission of drops from multiple jets. As a result, the overall time for drop detection can be imperceptible to the user of the printer. If smaller drops are ejected, the jet can be fired at a proportionally higher frequency for the same time to maintain the volume of ink constant and thus maintain the signal size. That is, the frequency of the droplet emission can be adjusted to accommodate various drop sizes.

Figure 11A:
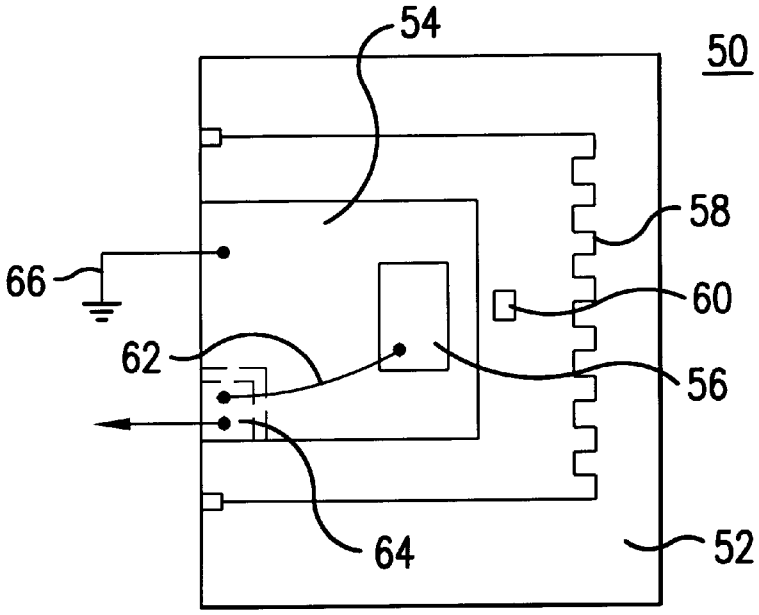
FIG. 11(*a*) is a front view of a drop detector in accordance with still another embodiment of the present invention.
Figure 11B:
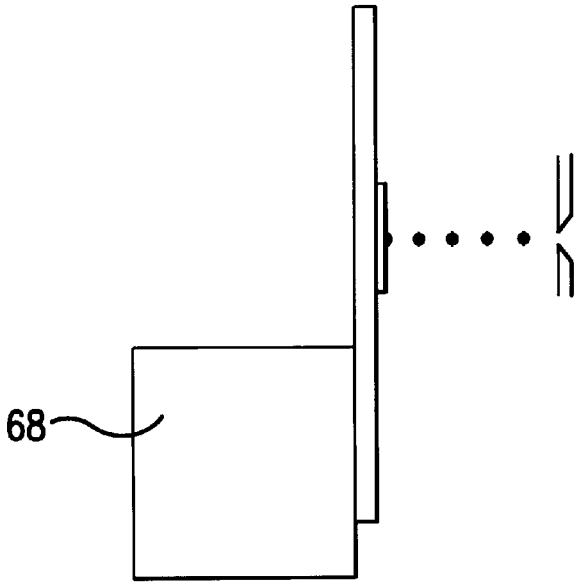

FIGS. 11(*a*) and 11(*b*) show a drop detector in accordance with another embodiment of the present invention which is generally indicated as reference character 50. The drop detector 50 includes a substrate 52 which has a plated gold film 54 covering a part of the surface of the substrate 52. The substrate 52 is preferably made of alumina ceramic or any one of other suitable ceramic materials. In a preferred embodiment, the substrate 52 is about 0.04" thick, about 1.2" wide and about 2.8" long.

The drop detector 50 includes a pyroelectric sheet 56 which is bonded to the plated gold film 54 on the substrate 52 with silver epoxy. The pyroelectric sheet 56 comprises a thin sheet of lead lanthanum zirconium titanate (PLZT), and conductor layers on both sides thereof which are formed from metal, such as, for example, nickel, silver and gold, for electrical connections to the PLZT sheet. In an exemplary embodiment, the pyroelectric sheet 56 is formed from a 0.005" thick gold and nickel coated PLZT sheet, manufactured by Motorola Corporation.

A resistance heater 58 is deposited, e.g. by plating techniques, onto the substrate 52 along one edge thereof to control the temperature of the pyroelectric sheet 56. A thermocouple 60 is bonded to the surface of the substrate adjacent the pyroelectric sheet 56 to monitor the temperature of the pyroelectric sheet 56. In the illustrated embodiment, a thin copper lead 62 is attached at one end thereof to the top surface of the pyroelectric sheet 56 with silver epoxy and soldered at the other end thereof to a pad 64 scribed into the plated gold film 54 to communicate the signal from the pyroelectric sheet 56. The gold plated film 54 may be grounded at 66, and a detection circuit (not shown) may be connected to the pad 64. The substrate 52 is attached at an edge area thereof spaced from the resistant heater 58 to an aluminum block 68, which acts as a heat sink.

The drop detector 50 was connected to a test equipment similar to that described with reference to FIG. 5, to determine and observe various characteristics of the drop detector 50.

It will be appreciated that the capacitance of the pyroelectric sheet 56 is smaller for a smaller area of the pyroelectric sheet 56. Therefore, in general, the smaller the size of the pyroelectric sheet 56, the larger the pyroelectric signal. Three sizes were tested, with the smallest size being 100 mil×100 mil, to observe the relationship between the capacitance and the size of the pyroelectric sheet. In these tests, 500 drops, each weighing about 42 ng, were fired at the emission frequency of 8 kHz. The gain was 1 and the detector temperature was about 90° C., and the capacitances were measured at 90° C. As a result, it was observed that, with capacitances of 0.88 nf, 2.08 nf and 3.22 nf, the peak signals were measured at 81.2 mv, 41.6 mv and 20.8 mv, respectively. This result shows an inverse relationship between the capacitance and the peak signal. Between measurements, the surfaces of the pyroelectric sheet 56 were wiped with a cotton swab. As a result, variations in the signal size of 10% were observed between "good" and "bad" cleaning steps.

Figure 12:
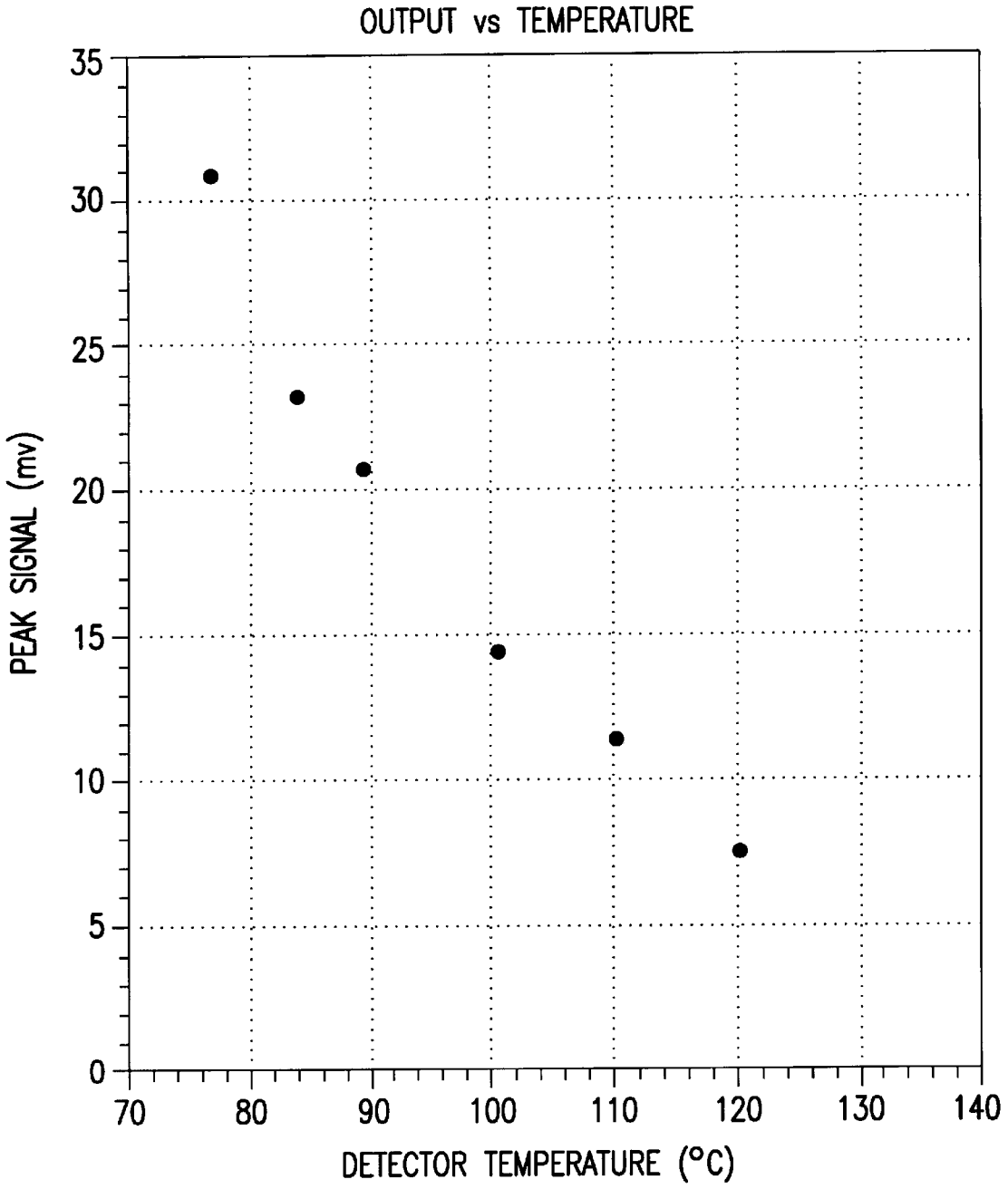
FIG. 12 is a graph showing a relationship between the signal amplitude and the temperature of the drop detector shown in FIG. 11.
Figure 13A:
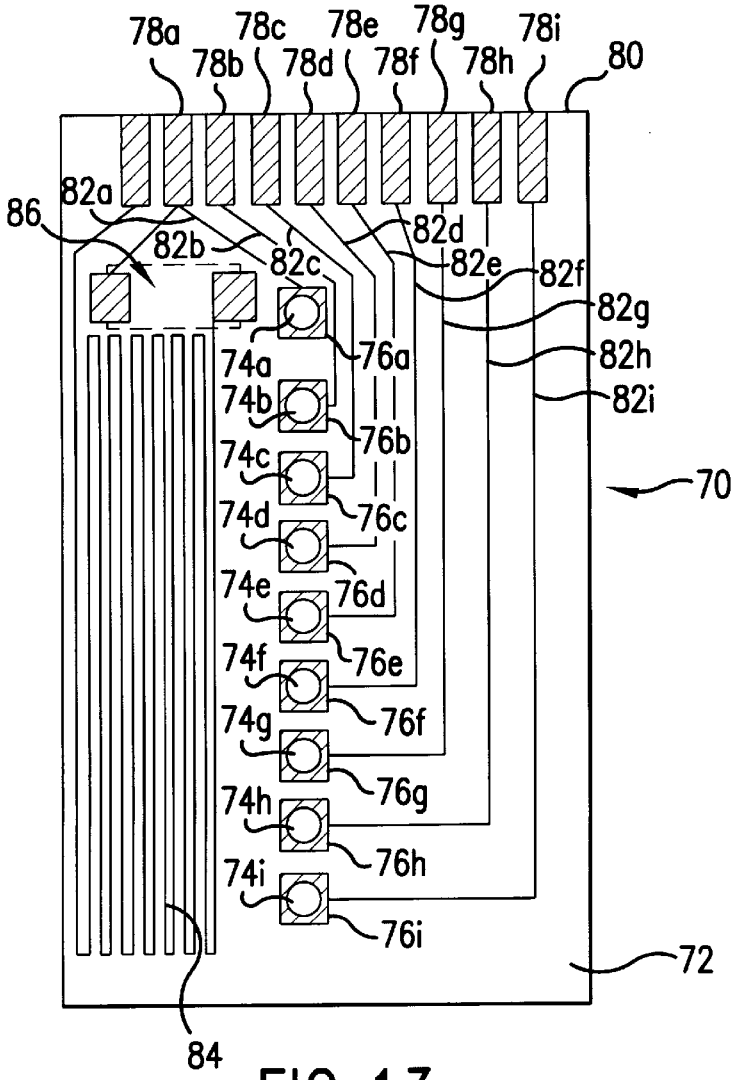
FIG. 13(*a*) is a rear view of a substrate with electrodes and heater disposed on the substrate for a drop detector in accordance with yet another embodiment of the present invention.
Figure 13B:
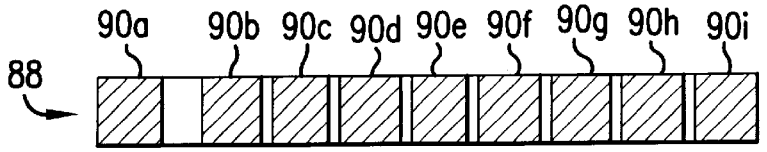
Figure 13C:
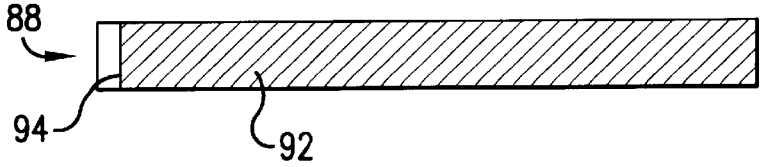
Figure 13D:
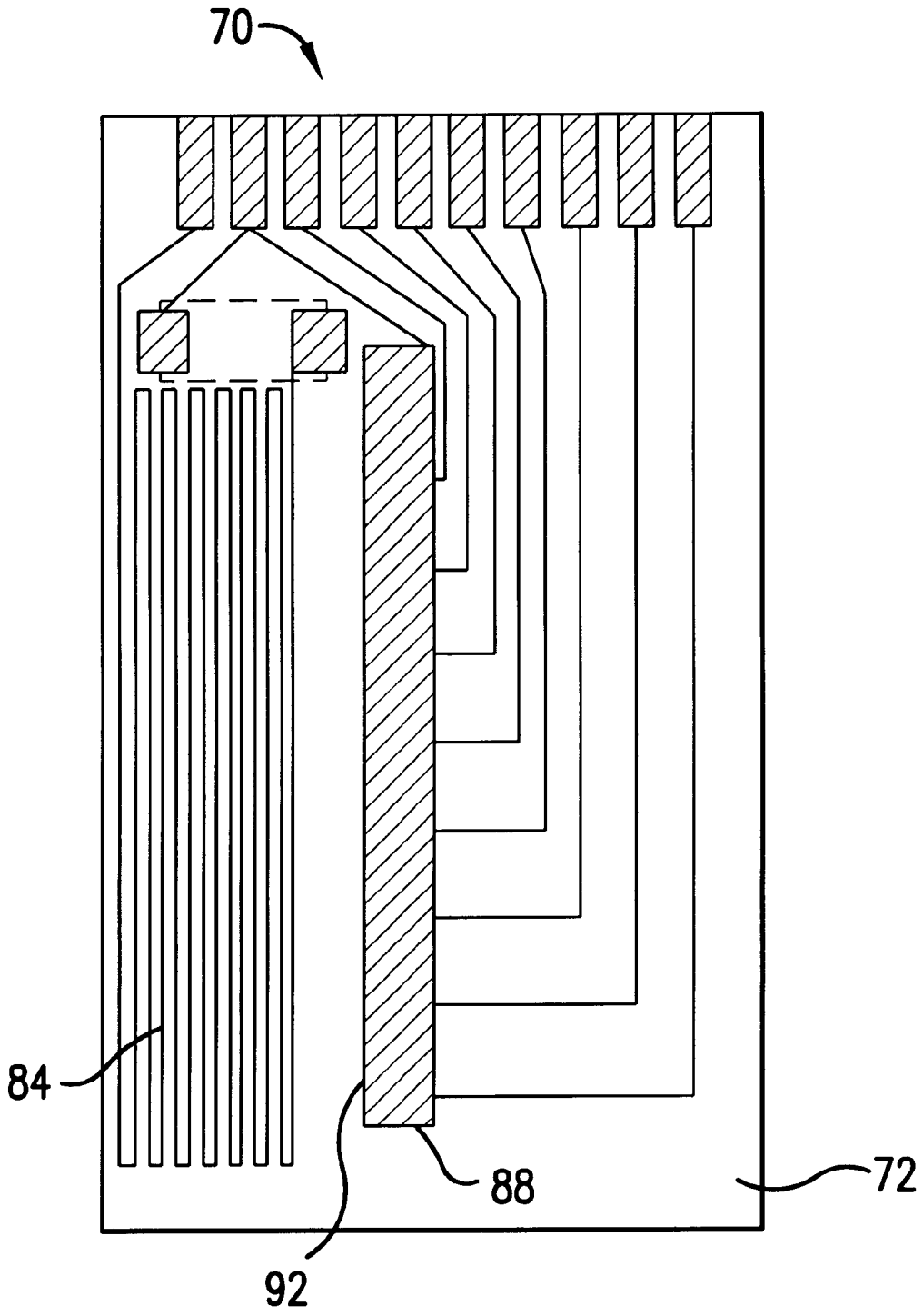

FIG. 12 shows the signal amplitude vs. the temperature of the drop detector 50. The temperature of the printhead was measured at 128.5° C. With this measurement, 500 drops, each weighing about 42 ng, of ink were fired at the emission frequency of 8 kHz. The plot shown in FIG. 12 shows that the temperature of the ink (by its relation to the peak signal) can be determined using the drop detector. According to the plot shown in FIG. 12, the sensitivity of the drop detector 50 is about 0.43 mv/° C.

Water based inks such as those used in bubble jets or Epson-like printers also can produce a signal. Because of their high heat capacity, a small temperature difference can be utilized. To illustrate this phenomenon, a 10 cP fluid made of diethylene glycol and water was tested. For one test, the drop detector was kept at ambient temperature (25.7° C.), and the printhead was heated at various temperatures. A burst of 300 drops, each weighing about 50 ng, fired at 8 kHz, produced the peak signal of 4 mv, 8 mv, 12.2 mv and 17 mv at jetpack temperature at 30° C., 40° C., 50° C. and 60° C., respectively. For another test, the jetpack was cooled to ambient temperature and the drop detector was heated to 40° C. This time, a negative first peak of 18 mv was seen due to the cooling, and a positive excursion of 4 mv followed. It is observed that inks which are liquid at room temperature can be detected in one of two ways: either by cooling a slightly heated detector or slightly heating the printhead. In either case, a temperature difference between the detector and the ink of at least about 15° C. is adequate.

As discussed above, a simplified construction for an array of drop detectors includes a single layer of pyroelectric material, such as, for example, PLZT membrane. The pyroelectric layer is provided between two electrically conductive electrode layers, one of which is etched or scribed to produce a plurality of electrode pads. Because only the electrically conductive surface layer is removed by etching or scribing, the detecting regions directly underlying the plural electrode pads are still coupled together thermally.

In a typical printhead, a plurality of jets are arranged in a row, with adjacent jets, for example 0.02 inches apart. Thus, a drop detector for such a device would include a plurality of electrode pads arranged in a row, and spaced about 0.02 inches apart. For smaller jet spacings, the pyroelectric sheet may be made thinner or may be segmented to correspond to the segmented electrode.

In a further embodiment, a detector may be configured to service a number of adjacent jets. For instance, a detecting region of 0.075 inches×0.02 inches could handle 4 adjacent jets, each 0.02 inches apart. The jets would be fired sequentially, for example, every 0.25 seconds. Eight such segments could handle 32 jets in 1 second. This approach reduces the number of electrical connections and electrode pads necessary and thus, simplifies the construction of the apparatus.

FIGS. 13(*a*), 13 (*b*), 13(*c*) and 13(*d*) show a drop detector in accordance with still another embodiment of the present invention which is generally indicated at 70 as shown in FIG. 13(*d*). Referring to FIG. 13(*a*), the drop detector includes a substrate 72 which is preferably made of alumina ceramic. In alternative embodiments, the substrate 72 may be formed from a PC board or a flex cable. In the illustrated embodiment, the substrate 72 is 0.040" thick, 0.60" wide and 1.0" long, and defines nine (9) vertically aligned apertures 74*a* through 74*i*.

Electrodes 76*a* through 76*i* are disposed about the respective apertures 74*a* through 74*i*, respectively. The electrodes 76*a* through 76*i* are electrically connected to pads 78*a* through 78*i* disposed along an edge 80 of the substrate via conductive wires 82*a* through 82*i*, respectively. A heater 84 is provided along the array of electrodes 76*a* through 76*i* for controlling the temperature of the drop detector 70. A PTC thermistor 86 is disposed between the edge 80 and the resistance heater 84, adjacent the electrode 74*a*, for monitoring the temperature of the drop detector 70.

FIGS. 13(*b*) and 13(*c*) show a segmented piezoceramic strip which is generally indicated at 88. The segmented piezoceramic strip 88 has segmented electrodes 90*a* through 90*i* one side as shown in FIG. 13(*b*). The piezoceramic strip 88 has a continuous electrode 92 disposed on the opposite side thereof as shown in FIG. 13(*c*). The continuous electrode 92 faces the ink jet head, and the segmented electrodes 90*b* through 90*i* are bonded to the electrodes 76*b* through 76*i* on the substrate 72, respectively, as shown in FIG. 13(*d*). One end 94 of the continuous electrode 92 is wrapped around and electrically connected to the electrode 74*a*. In the illustrated embodiment, 8 drop detectors are formed by segmenting the piezoceramic strip which is capable of simultaneous detection of bursts from 8 jets. Of course, other embodiments may include any suitable number of drop detectors. In one embodiment, when the drop detector 70 is used for detection of drops for an ink jet array (12×32 jets), it may take less than or equal to about 1 second to test one column of 32 jets, and less than or equal to 15 about seconds to test the full array of jets.

The ink deposited on the surface of the piezoceramic strip 92 from a first burst may interfere with the detection capability for future bursts. Therefore, for the detector to recover quickly, it is preferred that the ink run down the full length of the surface of the piezoceramic strip between test bursts. In one embodiment, the surface of the piezoceramic strip may be coated with a non-wetting material, such as, for example, polytetrafluorethylene, know as Teflon, so that the deposited ink quickly runs down the surface and does not interfere with the detection capability for future bursts of drops. Also, it is preferred that the strip define a smooth surface and be oriented vertically or near vertically.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A method of detecting liquid ejected from an ink jet apparatus, the ink jet apparatus including an array of ink jets, the method comprising:

from each of selected ones of the ink jets, ejecting at least one drop of liquid on a first surface of a thermosensitive detector, the thermosensitive detector having a pyroelectric material sandwiched between a first electrode on the first surface and a second electrode on a second surface of the thermosensitive detector, at least one of the first electrode and the second electrode being partitioned to form a plurality of detection regions on the first surface; receiving at each of the plurality of detection regions the at least one drop of liquid from exactly one of the selected ink jets; and detecting a temperature difference induced in at least one of the detection regions upon receipt of the at least one drop on the first surface by detecting a change in voltage between the first electrode and the second electrode at about the at least one detection region.

2. A method of detecting liquid according to claim 1, further comprising generating an electrical signal representative of the temperature difference at about the at least one detection region.

3. A method of detecting liquid according to claim 2, further comprising generating a signal waveform representative of the electrical signal over a period of time for each of the detection regions.

4. A method of detecting liquid according to claim 1, wherein the pyroelectric material is a piezoceramic material.

5. A method of detecting liquid according to claim 1, wherein the pyroelectric material is polyvinylidene fluoride.

6. A method of detecting liquid according to claim 1, wherein the pyroelectric material is lead zirconium titanate.

7. A method of detecting liquid according to claim 1, wherein the pyroelectric material is lead lanthanum zirconium titanate.

8. A method of detecting liquid ejected from an array of ink jets, each of the ink jets ejecting a jetable medium, the method comprising:

ejecting drops of the medium from selected ones of the ink jets;

positioning a thermosensitive device to receive drops of the medium on a detection surface partitioned into a plurality of detection regions, each of the detection regions being positioned to receive drops of the medium from exactly one of the selected ink jets; and providing a signal representative of a change in the temperature in each of the plurality of detection regions upon deposition of the drops of medium on the detection region.

9. The method of claim 8, the method further including:

sequentially selecting a set of ink jets in each of a plurality of detection intervals;

in each of the detection intervals, positioning each of the detection regions to receive drops of the medium from exactly one of the ink jets in the selected set; and ejecting the drops of the medium from the ink jets in the selected set substantially simultaneously at the detection interval.

10. The method of claim 8, wherein the array of ink jets is arranged in n rows by m columns and the thermosensitive device includes n detection regions, each of the n detection regions corresponding with one of the n rows of ink jets, the method further including positioning each detection region to sequentially receive drops of the medium from each ink jet in the row corresponding with the one ink jet at a time at set detection intervals.

11. The method of claim 8, wherein the array of ink jets includes a plurality of sets of spatially neighboring ink jets, each of the detection regions corresponding with one of the sets of spatially neighboring jets, the method further including positioning each of the detection regions to seqentially receive drops of the medium from each ink jet in the set corresponding with the detection region one ink jet at a time at set detection intervals.

12. The method of claim 8, wherein the thermosensitive device includes a pyroelectric material sandwiched between a first electrode and a second electrode, at least one of the first electrode and the second electrode being partitioned to form the plurality of detection regions on the detection surface of the first electrode.

13. The method of claim 8, the method further including positioning each of the plurality detection regions to receive drops of the medium from a corresponding one of the ink jets substantially simultaneous at set detection intervals.

14. A method of detecting drops of liquid ejected from an ink jet apparatus, the ink jet apparatus including an array of ink jets, the method comprising:

maintaining the liquid at a first temperature;

maintaining a thermosensitive detector at a second temperature, the thermosensitive detector having a pyroelectric material sandwiched between a first electrode and a second electrode, at least one of the first electrode and the second electrode being partitioned to form a plurality of detection regions on a detection surface of the first electrode;

from each of selected ones of the ink jets, ejecting drops of liquid on the detection surface over the plurality of detection regions;

receiving at each of the plurality of detection regions the at least one drop of liquid from exactly one of the selected ink jets; and detecting a temperature difference between the first temperature and the second temperature induced in each of the plurality of detection regions from the receipt of the drops of liquid on each of the plurality of detection regions of the substrate by detecting a change in voltage between the first electrode and the second electrode on each of the plurality of detection regions.

15. A method of detecting drops of liquid according to claim 14, wherein the temperature difference is generated in each of the plurality of detection regions by depositing at least one drop of liquid on each of the plurality of detection regions.

16. A method of detecting drops of liquid according to claim 15 further comprising generating an electrical signal representative of the temperature difference for each of the plurality of detection regions.

17. A method of detecting drops of liquid according to claim 16 further comprising generating a signal waveform representative of the electrical signal over a period of time for each of the plurality of detection regions.

18. A method of detecting drops of liquid according to claim 14, further comprising the step of using the pyroelectric material which is formed of polyvinylidene fluoride.

19. A method of detecting drops of liquid according to claim 14, further comprising the step of using the pyroelectric material which is formed of lead zirconium titanate.

20. A method of detecting drops of liquid according to claim 14, further comprising the step of using the pyroelectric material which is formed of lead lanthanum zirconium titanate.

21. A method of detecting drops of liquid according to claim 14, wherein the first temperature is greater than the second temperature for each of the plurality of detection regions.

22. A method of detecting drops of liquid according to claim 14, wherein the second temperature is greater than the first temperature for each of the plurality of detection regions.

23. In an apparatus for detecting a drop of ink ejected from an ink jet device, the ink jet device including an array of ink jets, the improvement comprising:

a thermosensitive device, the thermosensitive device having a pyroelectric material sandwiched between a first electrode and a second electrode, at least one of the first electrode and the second electrode being partitioned to form a plurality of detection regions on a detection surface of the first electrode, each of the plurality of detection regions being positioned to receive at least one drop of ink from exacting one of selected ones of the ink jets to initiate a signal representative of a change in the temperature on the detection surface; and a circuit for detecting a change in voltage between the first electrode and the second electrode about the one or more impinged detection regions.

24. An apparatus according to claim 23, wherein each of the plurality of detection regions has a first temperature and the at least one drop of ink has a second temperature, wherein for each of the plurality of detection regions the thermosensitive device provides a signal indicative of a temperature difference between the first temperature and the second temperature induced in the detection region upon deposition of the at least one drop of ink on the detection surface.

25. An apparatus according to claim 24, wherein the pyroelectric element is polyvinylidene fluoride.

26. An apparatus according to claim 24, wherein the pyroelectric element is lead zirconium titanate.

27. An apparatus according to claim 24, wherein the thermosensitive device comprises a substrate and a layer of pyroelectric material disposed on the substrate.

28. An apparatus according to claim 27, wherein the substrate is alumina ceramic and the pyroelectric material is polyvinylidene fluoride.

29. An apparatus according to claim 27, wherein the substrate is a printed circuit board having a layer of Cu plated on a surface, and the layer of pyroelectric material is a layer of polyvinylidene fluoride disposed on the plate of Cu.

30. An ink jet apparatus for jetting a jettable medium, the apparatus comprising:

an array of ink jets for ejecting drops of the jettable medium; and a thermosensitive device, the thermosensitive device having a pyroelectric material sandwiched between a first electrode and a second electrode, at least one of the first electrode and the second electrode being partitioned to form a plurality of detection regions on a detection surface of the first electrode, for receiving the drops of the medium and providing a signal representative of a change in the temperature in each of the plurality of the detection regions upon deposition of the drops of medium on the detection surface over each of the detection regions, wherein each of the detection regions is positioned to receive drops of the medium ejected from exactly one of selected ones of the ink jets.

31. An ink jet apparatus according to claim 30, wherein the ink jet head includes a first heater device for heating the medium at a first temperature and the thermosensitive device includes a second heater device for heating the thermosensitive device at a second temperature different from the first temperature.

32. An ink jet apparatus according to claim 30, wherein the ink jet head includes a portion adjacent the thermosensitive device and a first heater device for heating the portion thereof and the medium at a first temperature, and wherein the thermosensitive device is heated by the portion of the ink jet head at a second temperature different from the first temperature.

33. An ink jet apparatus for jetting a jettable medium, the apparatus comprising:

an array of ink jets for ejecting drops of the jettable medium; and a thermosensitive device having a detection surface partitioned into a plurality of detection regions for receiving the drops of the medium and providing a signal representative of a change in the temperature in each of the plurality of detection regions upon deposition of the drops of medium on detection region, wherein each of the detection regions is positioned to receive drops of the medium from a corresponding one of the jets at a set detection interval.

34. The ink jet apparatus of claim 33, wherein the array of ink jets is arranged in n rows by m columns and the thermosensitive device includes n detection regions, each of the n detection regions corresponding with one of the n rows of ink jets, and wherein each detection region is adapted to sequentially receive drops of the medium from each ink jet in the row corresponding with the one ink jet at a time at set time intervals.

35. The ink jet apparatus of claim 33, wherein the array of ink jets includes a plurality of sets of spatially neighboring ink jets, each of the detection regions corresponding with one of the sets of spatially neighboring jets, each of the detection regions being positioned to sequentially receive drops of the medium from each ink jet in the set corresponding with the detection region one ink jet at a time at set time intervals.

36. The ink jet apparatus of claim 33, wherein the thermosensitive device includes a pyroelectric material sandwiched between a first electrode and a second electrode, at least one of the first electrode and the second electrode being partitioned to form the plurality of detection regions on the detection surface of the first electrode.

37. The ink jet apparatus of claim 33, wherein each of the plurality detection regions is positioned to receive drops of the medium from a corresponding one of the ink jets substantially simultaneous at set detection intervals.

* * * * *

UNITED STATES PATENT AND TRADEMARK OFFICE

CERTIFICATE OF CORRECTION

PATENT NO. : 6,062,668
DATED : May 16, 2000
INVENTOR(S) : Tony Cruz-Uribe

It is certified that error appears in the above-identified patent and that said Letters Patent is hereby corrected as shown below:

Column 7,
Line 11, delete "of about 0.76 ng" and replace with -- of about 76 ng -- therefor.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*